US005638881A

United States Patent [19]

Ruggles et al.

[11] Patent Number: 5,638,881

[45] Date of Patent: Jun. 17, 1997

[54] BLIND WITH CURTAIN

[75] Inventors: Bryan K. Ruggles; Jace N. Green, both of Salt Lake City, Utah; Richard F. Chacon, Brea, Calif.

[73] Assignee: Newell Operating Company, Freeport, Ill.

[21] Appl. No.: 617,984

[22] Filed: Mar. 15, 1996

Related U.S. Application Data

[63] Continuation of Ser. No. 263,058, Jun. 21, 1994, abandoned.

[51] Int. Cl.[6] ..... E06B 9/30

[52] U.S. Cl. ..... 160/168.1; 160/89; 160/236

[58] Field of Search ..... 160/168.1 V, 176.1 V, 160/173 V, 172 V, 177 V, 168.1 R, 176.1 R, 173 R, 172 R, 177 R, 900, 236, 89, 199

[56] References Cited

U.S. PATENT DOCUMENTS

| | | |
|---|---|---|
| 1,937,342 | 11/1933 | Higbie . |
| 2,110,145 | 3/1938 | Loehr . |
| 3,092,870 | 6/1963 | Baer . |
| 3,302,690 | 2/1967 | Hurd . |
| 3,422,878 | 1/1969 | Galietti . |
| 3,851,699 | 12/1974 | Shapiro . |
| 3,946,789 | 3/1976 | Ronkholz-Tölle nee Tölle . |
| 4,114,233 | 9/1978 | Hamilton . |
| 4,438,605 | 3/1984 | DeLucia . |
| 5,012,552 | 5/1991 | Wulf . |
| 5,099,904 | 3/1992 | Susnar . |
| 5,102,598 | 4/1992 | Chen . |
| 5,105,870 | 4/1992 | Merjane . |
| 5,143,136 | 9/1992 | John . |
| 5,287,908 | 2/1994 | Hoffmann et al. . |
| 5,419,385 | 5/1995 | Vogel et al. . |
| 5,425,408 | 6/1995 | Colson . |
| 5,490,553 | 2/1996 | Colson et al. . |

FOREIGN PATENT DOCUMENTS

| | | |
|---|---|---|
| 0654577A1 | 5/1995 | European Pat. Off. . |
| 0653539A1 | 5/1995 | European Pat. Off. . |
| 1229987 | 9/1960 | France . |
| 3727363 | 3/1989 | Germany . |
| 627062 | 12/1981 | Switzerland . |
| WO94/25719 | 11/1994 | WIPO . |

*Primary Examiner*—David M. Purol
*Attorney, Agent, or Firm*—Foley & Lardner

[57] ABSTRACT

A blind assembly (10, 110) is disclosed including a plurality of elongated louvers (11, 111) and a curtain (30, 130). Each louver (11,111) has an edge (14,114) with an integral annular socket (20,120). The socket (20,120) receives a longitudinal cylindrical member (40,140) comprised of a pair of abutting semi-cylindrical beads (41,141). Each bead (41,141) is formed upon the marginal edges of a substrate (31,131), a plurality thereof forming the curtain (30,130).

18 Claims, 3 Drawing Sheets

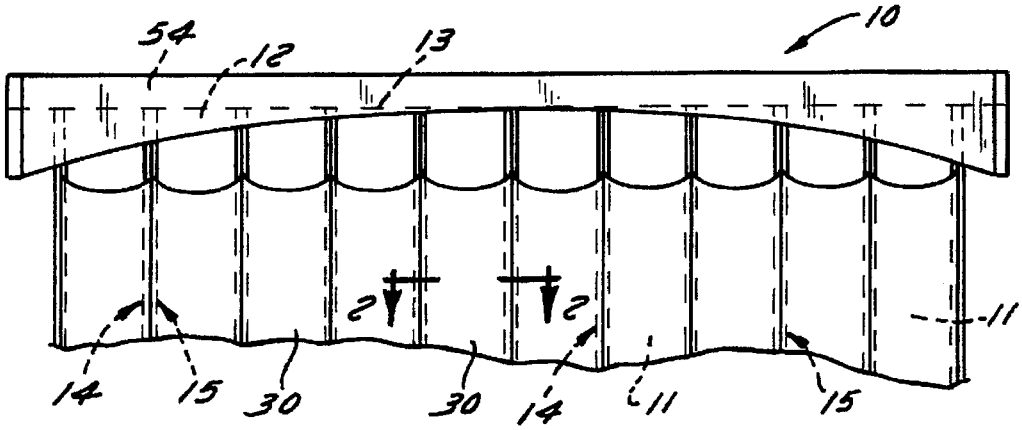
FIG. 1
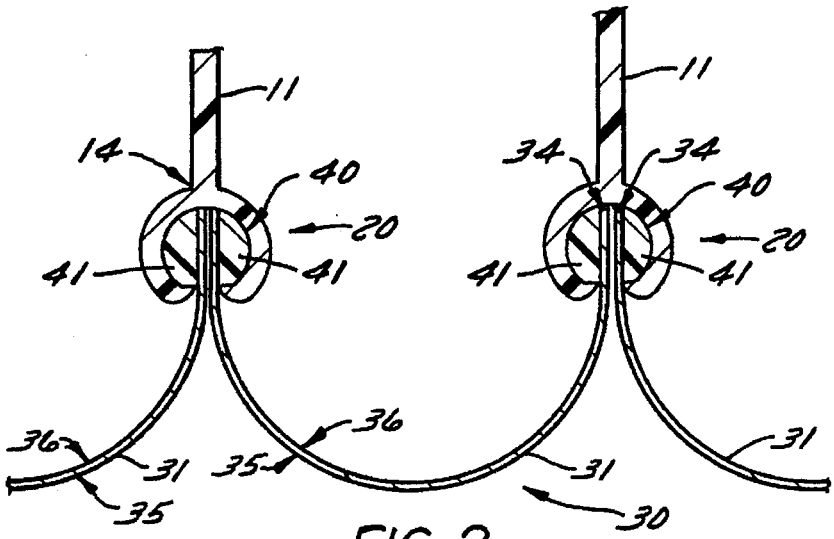
FIG. 2
FIG. 3
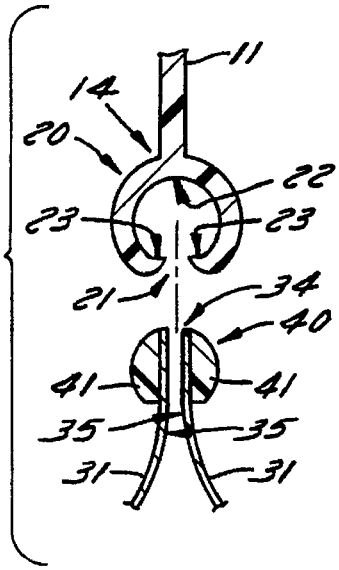
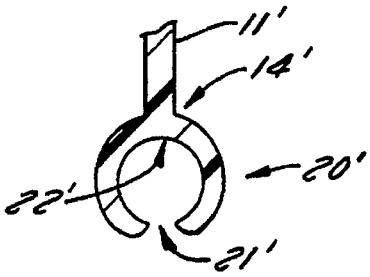
FIG. 4

BLIND WITH CURTAIN

This is a continuation of application Ser. No. 08/263,058 filed Jun. 21, 1994 abandoned.

TECHNICAL FIELD

The present invention relates generally to blind systems, and more particularly, to a vertical louver blind incorporating a plurality of elongated slats and an integral, sheer curtain face.

BACKGROUND OF THE INVENTION

The advent of vertical louver type venetian blinds has brought about new concepts in interior design in commercial and residential installations. Vertical louver type venetian blind systems have been particularly well received in contemporary architecture where relatively large expanses of window glass are utilized or large room partitions are desired. The vertical louver type venetian blind may be of substantial vertical height and, when closed, may extend along a considerable horizontal length to cover a wall, a window, or to partition a room.

Conventional louvers, also called slats or vanes, of a vertical blind are adapted for lateral movement between an open blind position, when the blind is drawn to one or opposite ends of a support track or channel adjacent their tops, and a closed position, when the louvers are positioned in generally equal spaced relation to one another along the length of the support track or channel. The louvers are also adapted for selective rotation about their longitudinal axis between open and closed positions when in the closed blind position to control the amount of light entering between the louvers into or out of the adjacent room.

The vertical louvers may be made of vinyl or other suitable material, colored to add an accent color to the room or colored to blend with the primary color of the room. The louvers may also be made or covered with a fabric material to achieve a specific design effect.

SUMMARY OF THEN INVENTION

The present invention adds additional features to the louver blinds, especially vertical louver venetian blinds, to enhance interior design aspects. In particular, a curtain is attached to the leading or front edge of the blind to alter or soften the effect of the blind when the blind is closed and the louvers are in an open or partially-open position.

According to a first aspect of the present invention, a socket is constructed along and integral with the front edge of each louver. This socket includes an arcuate interior and a passageway therein communicating between the socket and exterior thereof. A longitudinal cylindrical member attached to the curtain fits within and is frictionally engaged by the internally cylindrical defining walls of the socket. As a result, the curtain is disposed and passes adjacent the vertical louvers and when the blind is closed and the louvers are rotated closed, the blind viewed from a room appears as a pleated, hanging soft curtain, the draped louvers overlapping one another so as to prevent light from coming into the room. In addition, when the blind is still in its closed position and the louvers are rotated to their open position, the light coming through the window passes through the soft curtain, with the slats acting as light vanes.

Either the cylindrical bead member or a section of the curtain, or both, passes through the passageway in the elongated socket.

According to another aspect of the present invention, the curtain is formed of a plurality of panels, that being substantially rectangular, abutting substrates of fabric strips, each substrate having a semi-cylindrical bead segment of about half the size of each cylindrical member attached to opposite vertical marginal edges thereof. The cylindrical member is formed of two abutting bead segments.

According to yet another aspect of the present invention, each socket includes internal means for enhancing the frictional engagement of the cylindrical member, which is comprised of two bead segments. The enhancing means includes internal camming surfaces adjacent the passageway.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which:

FIG. 1 is a front elevation view of a vertical blind system in the closed position having vertical louvers;

FIG. 2 is a top sectional view of the longitudinal edge of two louvers along line 2—2 of FIG. 1, in the open position, with a curtain attached thereto;

FIG. 3 is a detail top sectional view of a longitudinal edge of the louver and the curtain assembly attached thereto;

FIG. 4 is a second embodiment of the longitudinal edge of a louver;

FIG. 2 is another schematic diagram of a horizontal blind system.

DETAILED DESCRIPTION

Figure 5:
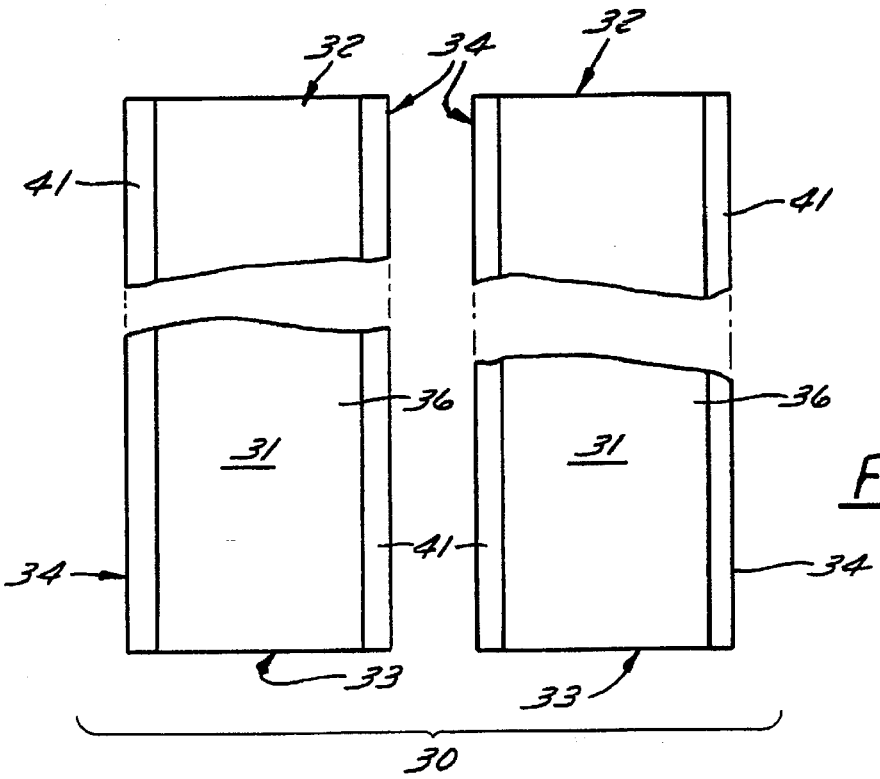
FIG. 5 is an elevation view of two adjacent, separated substrates.

While this invention is susceptible of embodiment in many different forms, there is shown in the drawings and will herein be described in detail the preferred embodiments of the invention with the understanding that the present disclosure is to be considered as an exemplification of the principles of the invention and is not intended to limit the broad aspect of the invention to the embodiments illustrated.

As shown in FIG. 1, a typical blind assembly 10 includes a plurality of free-hanging elongated vertical louvers 11. Each of the vertical louvers 11 is supported adjacent its upper end 12 thereof so as to hang in a substantially vertical position. The louvers hang at preselected, spaced relation to one another in a manner which enables each of the louvers to rotate about each's longitudinal axis of rotation between an open louver position (FIG. 2) and a closed louver position (FIG. 1). Each louver 11 has a bottom edge (not shown), a top edge 13, a front, or leading, longitudinal edge 14 and a back longitudinal edge 15. The louvers are laterally sized so the front edge, or marginal edge, of each louver overlaps the back edge of the next adjacent louver in the closed louver position; this is shown in FIG. 1.

A hollow cylindrical protuberance, or a socket 20 is formed at the front margin along and integral with the front edge 14 of each louver 11. The socket 20 has an arcuate, generally cylindrical interior 22 and at the distal end of the socket 20 there is a longitudinal passageway 21 that opens to the exterior. As shown, this passageway 21 may run parallel to the front edge 14. A curtain 30 is disposed across the front of the louvers and passes adjacent the front edge of the louvers. This curtain 30 has a plurality of parallel, longitudinal cylindrical members 40 attached thereto that are anchored to the louvers.

The cylindrical members 40 integral with the curtain 30 cooperate with the sockets 20 integral with the front edge 14 of the louvers 11. Specifically, each longitudinal cylindrical member 40 slideably fits within one of the longitudinal sockets 20. Each socket receives and resiliently frictionally engages, or grips, a longitudinal cylindrical member. The socket 20 is slightly larger than the associated, cooperating cylindrical member. The resiliency of the walls forming each socket on opposite sides of the passageway enable the socket to tightly grip the cylindrical member therein. A retaining clip engaged at the top of each vane can also hold the curtain.

Figure 10:
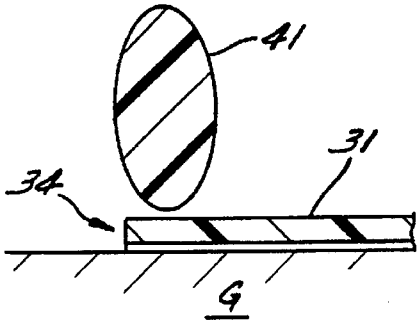
FIG. 10 is a schematic of the extruded cylindrical bead as it leaves the nozzle.
Figure 11:
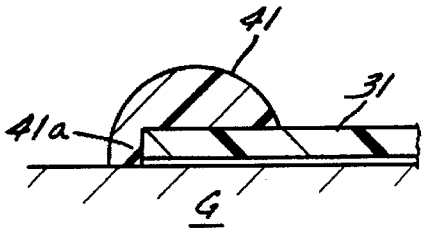
FIG. 11 is detail of the cylindrical bead forming on the fabric.

The details of the curtain are seen in FIGS. 2, 3 and 5. The curtain 30 is formed of a plurality of panels, that being substantially rectangular, substrates or fabric strips 31 that abut one another. Each substrate has a top edge 32 and a bottom edge 33 and two vertical marginal or side edges 34. A semi-cylindrical bead 41 is attached to or laid upon the substrate 31 adjacent each of the vertical marginal edges 34. To be precise, the bead is extruded onto the fabric edge so as to extend beyond the edge, capturing and covering all loose fibers and yarns. This prevents fraying which can occur over time. This is shown in FIGS. 10 and 11 which show the extruded bead 41, which is elongated, or parabolic, as it is extruded from a parabolic nozzle (not shown) onto the fabric 31. The fabric is resting upon a horizontal surface (ground G).

Upon contacting the fabric 31, the bead 41, by the force of gravity, settles so there is an overhang 41a extending beyond the edge 34 of the fabric.

The cylindrical member 40 that cooperates with each louver's socket 20 is formed of two abutting semi-cylindrical beads 41. Accordingly, the beads 41 are sized slightly smaller, when combined, than the sockets 20 they cooperate with.

As seen in FIGS. 2 and 5, each substrate, or strip of fabric 31 has two sides, namely a front side 35 and a back side 36. The semi-cylindrical beads 41 are extruded on or laid on one of the sides, preferably the back side 36 of the substrate or strip. The vertical side edges 34 of adjacent substrates 31 are aligned with one another and the substrates are placed with their front sides 35 against one another. In this manner one semi-cylindrical bead 41 from one substrate 31 forms half the cylindrical member 40 and the other semi-cylindrical bead 41 from the adjacent substrate 31 forms the other half of the overall cylindrical member 40. Once disposed against each other, the two beads 41 forming a cylindrical member 40 may be slid or threaded into the socket 20. This may be accomplished by inserting the cylindrical member through an opening at the top 13 or the bottom of the louver 11 and pulling the cylindrical member with the attached curtain down or up, depending on the starting point. The curtain may also be threaded horizontally on an assembly fixture.

Threading may also be accomplished by opening the socket 20 by spreading the annular passageway 21 apart and inserting the cylindrical member. The passageway then goes back and collapses to its original position around the cylindrical member. This second method of threading may be progressively performed along the length of the louver.

Figure 8:
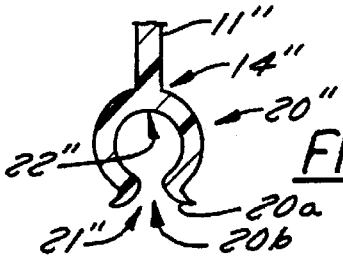
FIG. 8 is a third embodiment of the longitudinal edge of a louver.

To effectuate and simplify the second method of threading the cylindrical member, the walls of the socket adjacent the passageway 21" communicating with interior cylindrical surface 22" may be turned outwardly. Specifically, as shown in FIG. 8, the socket 20" of louver 11" proximate front edge 14" includes two projections 20*a* adjacent each side of the passageway 21". These projections 20*a* also include rounded surfaces 20*b* to assist in the threading operation. The structure relieves some of the stresses placed on the fabric.

During and after threading of the cylindrical member into the elongated socket, the two adjacent, abutting substrates forming the curtain, pass through the passageway of the socket. One substrate hangs and cooperates with a socket on the louver adjacent the first attached louver's one side via a bead laid adjacent the substrate's other marginal edge and the other substrate hangs and cooperates with a socket on the louver adjacent the first louver's other side via a bead laid adjacent the substrate's other marginal edge.

A socket 20" alone of a single louver 11' is shown in FIG. 4. The louver 11' of FIG. 4 includes a front edge 14'. Socket 20' includes an arcuate cylindrical surface 22' and a passageway 21' communicating therewith to enhance the frictional grip on the cylindrical member therein, the socket 20 may be provided with an internal flat, camming surface 23 therein. Specifically, the portions of the arcuate cylindrical interior surface 22 of the socket 20 adjacent the passageway 21 is flattened 23 (FIG. 3) and roughened to provide bead-gripping teeth or a flat stopping surface to press against the cylindrical member.

With the present invention, when the blind is closed and the louvers are rotated closed, as in FIG. 1, the assembly viewed from a room appears as a pleated, soft hanging curtain, the draped louvers overlapping one another and preventing light from passing into the room. When the louvers are rotated to their open position, wherein they are spaced and parallel one another, the light coming through the window passes through the curtain, with the slats acting as light vanes which control the amount of light entering the room. Both the material of the curtain or substrates and the angles of the louvers will affect the appearance of the blind. The louvers are preferably made of poly-vinyl-chloride ("PVC") plastic. Suitable materials for the curtain include woven or knitted, sheer, semi-sheer and opaque fabrics. Aesthetically pleasing non-woven fabrics may also be used. To obtain the rounded curtain look, as shown in FIG. 2, a knit fabric looks better than a woven fabric. The knit fabric is stronger in the horizontal or transverse fill direction than the vertical warp direction.

Regarding the semi-cylindrical beads formed on the substrates, they may be made of an extruded thermo-plastic applied to or adhered to the fabric. The beads may also be made of an applied hot melt adhesive such as polyurethane or other synthetic polymer which provides the bead characteristics desired.

Figure 6:
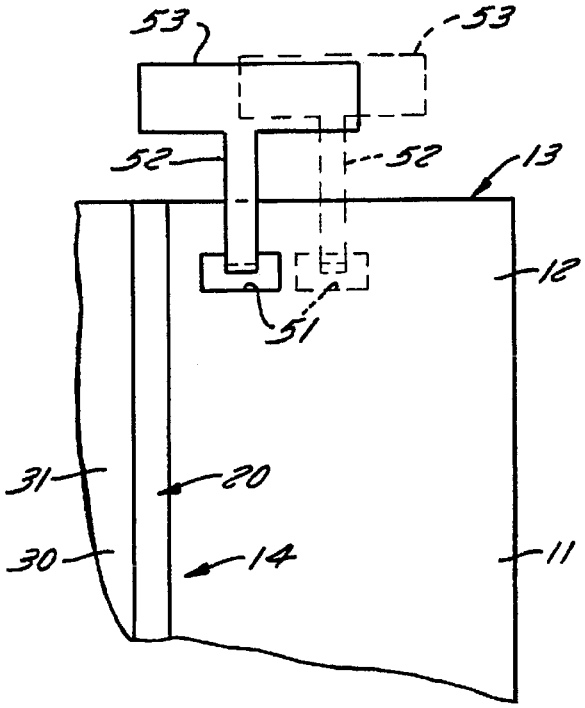
FIG. 6 is a detail of the top of a louver.

As previously noted, each louver is free-hanging and supported adjacent its upper end 12. Specifically, as shown in FIG. 6, each louver has an aperture 51 therein positioned below the top edge for receiving a hook (not shown). The hook is at the distal end of an arm 52 extending from a carrier 53. Each carrier 53 is positioned and controlled in the headrail 54 of the blind 10.

Typically, the aperture is centrally disposed between the front edge 14 and back edge 15 of the louver 11. This is shown in phantom in FIG. 6. In this manner, the louver is balanced to hang substantially vertical. However, in the louvers of the present invention, the leading edge 14 includes a socket with both a cylindrical member 40 and attached curtain 30 interconnected thereto which increases the weight of the front of the louver. To accommodate and compensate for the weight and the moments resulting therefrom, the transverse aperture 51 in the louver is shifted forwardly on the louver 11. The shifting or off-setting is shown in solid lines in FIG. 6. As a result, with the shifting and hanging from the center of gravity, the louvers hang freely and vertically. The louvers may also be made into a curved configuration for rigidity and uniformity.

An alternative way of balancing the hanging louvers is to form identical sockets, as the ones discussed above, along each of the two vertical edges of the louver and thread one socket with the cylindrical members formed of two beads and the other socket with a weight, such as a metal rod. As a result, the weight held within the one socket will counterbalance the weight of the curtain placed on the other socket.

In addition, because of the weight of the curtain, there is a possibility of the curtain creeping downwardly (due to gravity) relative to the blind. Accordingly, retaining means may be provided adjacent the top of the louvers to ensure that the cylindrical members and beads attached to the curtain, or weights do not slide in the sockets once the blind is in place. Such retaining means may include clips or clamps.

Further, as to the louvers at each outer end of the blind, the outermost substrate wraps around the outermost surface of the louver and attaches to the rear edge of the louver. When the louvers are rotated, especially the outer end louvers, they are not visible to the eye, but covered by the curtain, namely the substrate. Similarly, the blind appears to be encased or encapsulated by the curtain when viewed from the ends and in front.

Figure 7:
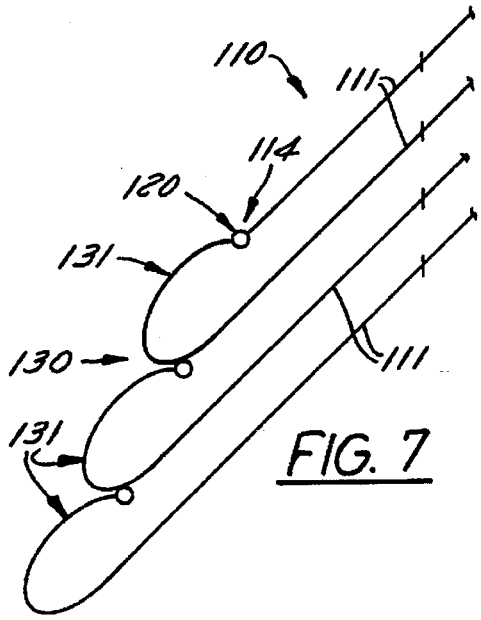
FIG. 7 is a schematic diagram of a horizontal blind system.

While the embodiments described have been directed to vertical blind systems, the present invention is applicable to horizontal blind systems as well. As shown in the schematic diagram of FIG. 7, a blind system 110 of equally spaced slats 111 has sockets 120 adjacent each slat's leading or front edge 114. A curtain 130 comprised of a plurality of fabric strips or substrates 131 with beads adjacent each end. The curtain is attached to horizontal louvers in the same manner as with the vertical louvers.

Figure 9:
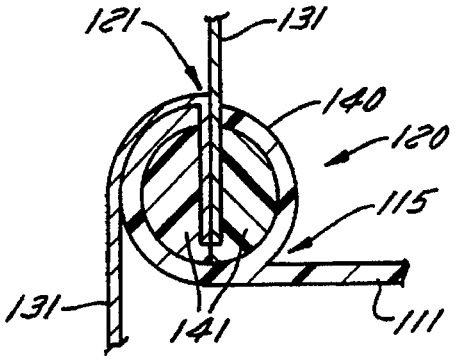
FIG. 9 is detail side sectional view of a horizontal louver and curtain assembly attached thereto.
Figure 12:
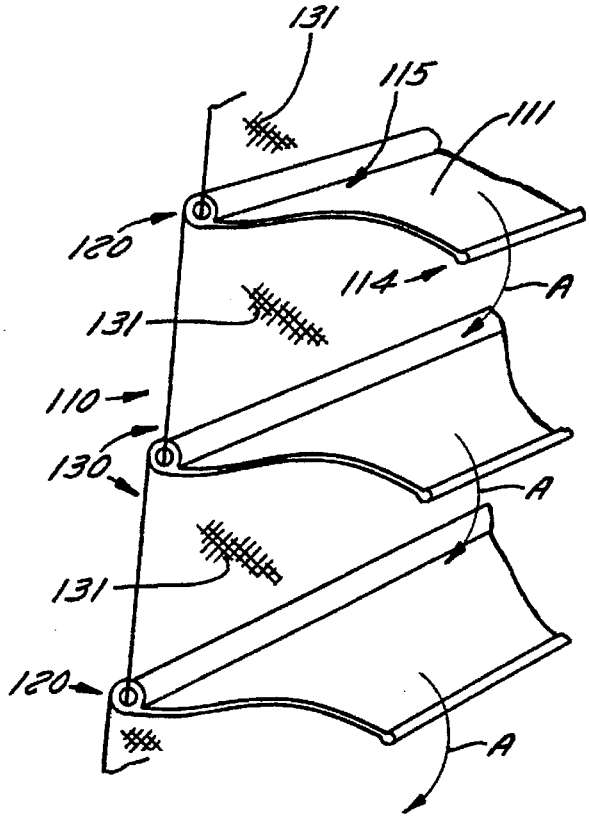

In addition, as shown in the detail of FIG. 9, the annular passageway 121 of each socket 120 may be rotated ninety degrees. In this manner, the two fabric segments 131 in each socket 120 will project upwardly and downwardly respectively. Consequently, when the sockets 120 for the cylindrical beads 141 are constructed on the back edge 115 of the louvers 111, the rotation of the louvers may be easily controlled by the tension placed on the fabric 131. When the fabric is in tension, the louvers will project outwardly (see FIG. 12), and when the fabric is relaxed, the louvers will collapse, or drop, due to gravity (arrows A in FIG. 12).

While the specific embodiments have been illustrated and described, numerous modifications come to mind without significantly departing from the spirit of the invention and the scope of protection is only limited by the scope of the accompanying Claims.

We claim:

1. A blind assembly having a plurality of elongated louvers, each louver having a leading edge, comprising:

a socket having internal walls along and integral with the leading edge of each louver;

a longitudinal member fitting within and frictionally engaged by said internal walls of said socket;

a curtain disposed and passing adjacent the louvers and being secured to said member, said socket having a passageway therein and one of said member and said curtain passing therethrough.

2. The blind assembly as defined in claim 1 wherein said curtain has a plurality of parallel, longitudinal members attached thereto, each said member slideably fitting within one said socket.

3. The blind assembly as defined in claim 1 wherein said curtain is formed of a plurality of substantially rectangular substrates abutting at adjacent edges, each said substrate having a bead segment attached to each marginal edge thereof and said member is formed of abutting beads.

4. The blind assembly as defined in claim 3 wherein two said beads slideably fit within said sockets, said members formed of two abutting beads.

5. The blind assembly as defined in claim 1 wherein said socket includes internal means for enhancing said frictional engagement of said member.

6. The blind assembly as defined in claim 5 wherein said means for enhancing said frictional engagement of said member is an internal camming surface therein.

7. The blind assembly as defined in claim 5 wherein said means for enhancing said frictional engagement of said member is a flattened camming surface therein.

8. A blind assembly having a plurality of elongated louvers, each louver having a front leading edge and an opposite edge, the blind assembly, comprising:

a socket having a passageway therein communicating with the exterior thereof and integral with the front leading edge of each louver; and, a curtain including a plurality of parallel longitudinal members attached thereto, said curtain disposed and passing adjacent each front leading edge, each longitudinal member fitting within said socket.

9. The blind assembly as defined in claim 8 wherein said curtain includes a plurality of adjacent substrates, each substrate including a pair of marginal edges, each marginal edge having a longitudinal bead attached thereto, wherein each pair of adjacent beads of adjacent substrates form said members.

10. The blind assembly as defined in claim 9 wherein said members formed of said adjacent beads slidably fits within said sockets.

11. The blind assembly as defined in claim 10 wherein said socket includes a mechanical attachment for securing said member within said socket.

12. A blind assembly having a plurality of free-hanging elongated vertical louvers supported at adjacent upper ends thereof so as to hang in substantially vertical positions at preselected, spaced relations to one another and to enable rotation of the louvers about longitudinal axes of rotation between an open louver position and a closed louver position, each louver having a bottom and a top edge and a front and a back longitudinal edge and each being laterally sized so the front edge of each louver overlaps the back edge of the next adjacent louver in the closed louver position, comprising:

a vertical socket along and integral with the front vertical edge of each louver and having a vertical passageway therein communicating to the exterior thereof;

a vertical cylindrical member fitting within and frictionally engaged by interior walls of said socket;

a curtain disposed and passing adjacent the vertical louvers and having spaced portions thereof respectively being secured to said cylindrical member, one of said cylindrical member and said curtain passing through said passageway, said curtain being formed of a plurality of substantially rectangular substrates abutting at adjacent marginal edges, each of said substrates having a semi-cylindrical bead attached adjacent to said marginal edges thereof and said member being formed of two abutting beads.

13. The blind assembly as defined in claim 12 wherein said socket includes internal means for enhancing said frictional engagement of said cylindrical member.

14. The blind assembly as defined in claim 13 wherein said means for enhancing said frictional engagement of said cylindrical member is an internal camming surface therein.

15. A blind system comprising:

a plurality of spaced louvers substantially parallel to one another at preselected, spaced relations to one another and to enable rotation of said louvers about longitudinal axes of rotation between any open louver position and a closed louver position, each said louver having a front and a back longitudinal edge and each being longitudinally sized so said front edge of each said louver overlaps said back edge of the next adjacent louver in said closed louver position, each louver including a socket along and integral with said front edge, each socket including a passageway therein communicating to the exterior thereof;

a longitudinal member fitting within said sockets; and, a curtain disposed and passing adjacent said front edges of said louvers and having spaced portions thereof respectively being secured to said longitudinal members.

16. The blind assembly as defined in claim 15 wherein said curtain includes a plurality of adjacent substrates, each substrate including a pair of marginal edges, each marginal edge having a longitudinal bead attached thereto, wherein each pair of adjacent beads of adjacent substrates form said members.

17. The blind assembly as defined in claim 16 wherein said members formed of said adjacent beads slidably fits within said sockets.

18. The blind assembly as defined in claim 15 wherein said louvers are horizontal.

* * * * *